United States Patent [19]

Tessier

[11] 4,354,767

[45] Oct. 19, 1982

[54] MECHANICAL PENCIL

[75] Inventor: Aram J. Tessier, Warwick, R.I.

[73] Assignee: T & T Mfg. Co., Providence, R.I.

[21] Appl. No.: 161,266

[22] Filed: Jun. 20, 1980

[51] Int. Cl.[3] ..... B43K 21/10

[52] U.S. Cl. ..... 401/63; 401/64; 401/70; 401/86

[58] Field of Search ..... 401/55, 63, 64, 70, 401/75, 76, 86, 87

[56] References Cited

U.S. PATENT DOCUMENTS

| | | | |
|---|---|---|---|
| 1,425,871 | 8/1922 | Liddell | 401/63 |
| 2,015,673 | 10/1935 | Hauten | 401/63 |
| 2,110,550 | 3/1938 | Friedlein et al. | 401/63 |
| 2,172,349 | 9/1939 | Hauton | 401/87 X |
| 2,511,301 | 6/1950 | Smith | 401/86 X |
| 2,690,737 | 10/1954 | Lynn | 401/63 |
| 2,767,687 | 10/1956 | Vierling | 401/63 |
| 3,139,066 | 6/1964 | Aversa | 401/64 |

*Primary Examiner*—Edward M. Coven

*Attorney, Agent, or Firm*—Thompson, Birch, Gauthier & Samuels

[57] ABSTRACT

A mechanical pencil has a clutch feature which prevents the breakage of the lead-carrying mechanism when the mechanism is advanced or retracted too hard or encounters an obstruction anywhere during its travel along the guide tube. The stationary lower barrel and guide tube are rotatably fixed to a rotating upper cap, knurled bushing and worm spring which drive the lead carrier along the stationary guide tube to advance and retract the lead. The lower end of the worm spring and the upper end of the cap bushing are linked together by clutch means which permits their relative slippage when excessive torque forces are encountered.

3 Claims, 14 Drawing Figures

MECHANICAL PENCIL

BACKGROUND OF THE INVENTION

In previous mechanical pencils, breakage of the lead-carrying mechanism has occasionally occurred when the mechanism was briskly retracted against the upper or lower ends of the guide tube. The damage usually consists of deformation of the radially extending ears of the mechanism.

It is an object of this invention to provide a clutch unit between the lower end of the worm spring which drives the lead-carrying mechanism, and the upper end of the bushing which is fixed to the upper exterior cap. The clutch unit permits relative slippage between the bushing and the worm spring when the relative torque therebetween exceeds a selected level.

SUMMARY OF THE INVENTION

Figure 1:
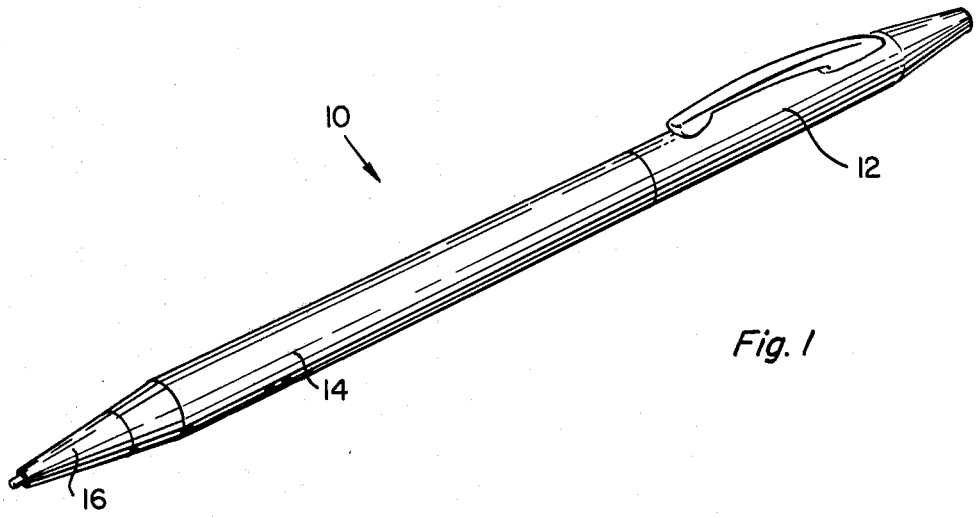
FIG. 1 is a perspective view of a mechanical pencil of the type in which this invention is used.

A conventional mechanical pencil has a stationary lower exterior barrel. A lower interior cylindrical portion is fixed within the barrel. A hollow guide tube having a longitudinal slot along one side is fixed to and extends upwardly from the upper end of the cylindrical portion. These are all of the stationary elements.

A knurled cap bushing is rotatably mounted on the guide tube above the upper end of the cylindrical portion. To rotate the cap bushing, an upper exterior cap is fitted over and fixed to the knurled portion of the bushing cap. A radially extending stop means is provided at the upper end of the guide tube. A worm spring is rotatably mounted on the guide tube and is compressed between the upper end of the cap bushing and the stop means at the upper end of the guide tube. The worm spring biases the rotatable knurled cap bushing against the stationary cylindrical portion. These are all of the rotatable elements.

In order to propel the lead back and forth, a tubular lead carrier fits within the guide tube and is slidable along the tube. The lead carrier has a lower apertured end for resiliently gripping the pencil lead and a closed upper end. The lead carrier is formed with a radially extending ear which protrudes from near the carrier's midpoint. The lead carrier is also formed with a slot which extends from the ear up to the closed upper end of the lead carrier. A lead expeller rod is slidably fitted within the lead carrier and has a similar radially extending ear which protrudes from the lead carrier slot. The lead expeller rod can be reciprocated in the lead carrier.

The downstream lead carrier ear and the upstream lead expeller rod ear are maintained apart by the interposition of one turn of the helical worm spring. As the worm spring rotates about the guide tube, the ears are cammed along the guide tube slot to move the lead carrier longitudinally. The elements which have so far been described are all conventional.

The upper exterior cap is rotated relative to the stationary lower exterior barrel to rotate the knurled cap bushing and the worm spring. This rotational action causes the lead carrier to advance or retract. The problem that this invention is designed to solve usually occurs when the lead expeller rod ear slams into the upper or lower ends of the guide tube. The ear can easily be deformed because the torque load becomes instantaneously quite high. Also, other parts of the mechanism can be damaged.

Therefore, this invention provides a clutch means between the lower end of the worm spring and the upper end of the cap bushing. The clutch means causes these two elements to slip relative to each other only in the event of the occurrence of an excessive torque load. The operative torque load level can be selected by choosing appropriate clutch element faces which have the desired coefficients of friction. The clutch means operates to prevent hard rotation of the exterior cap from rotating the worm spring too far.

DESCRIPTION OF THE PREFERRED EMBODIMENT

The mechanical pencil 10 has an upper exterior cap 12 and a lower exterior barrel 14. A tip 16 is threadably engaged to an interior element (later described) and urges interior elements snugly against the lower barrel.

Figure 2:
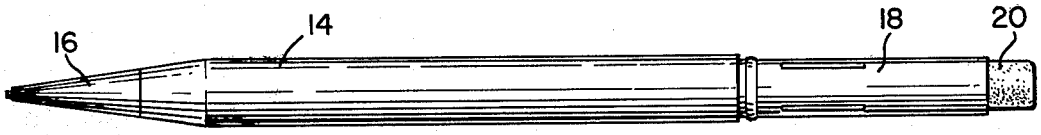
FIG. 2 is a view of the mechanical pencil of FIG. 1 in which the upper exterior cap has been removed.
Figure 3:
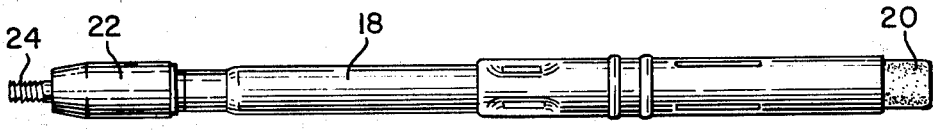
FIG. 3 is a view of the mechanical pencil of FIG. 2 in which the lower exterior barrel has been removed.
Figure 4:
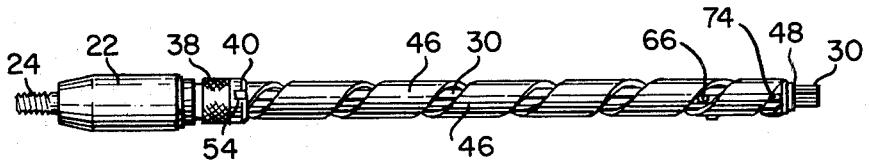
FIG. 4 is a view of the mechanical pencil of FIG. 3 in which the intermediate tube has been removed.

As FIGS. 2 and 3 show, beneath the exterior cap and barrel is an intermediate hollow tube 18 which holds loose lead in its upper portion and holds a removable eraser 20 at its upper end. The intermediate tube 18 is tightly gripped by cap 12, and itself tightly grips an interior bushing.

Beneath the intermediate tube 18 is a lower interior cylindrical portion 22. Cylindrical portion 22 has a threaded lower tip 24, a substantially solid central portion 26, and a counterbored upper portion 28. This bore has a larger diameter in the upper portion 28. The cylindrical portion 22 is sized and shaped to fit snugly within the lower exterior barrel 14, and the threaded exterior tip 16 engages interior tip 24 and pulls the cylindrical portion 22 downwardly and into tight engagement with exterior barrel 14. By this means, cylindrical portion 22 is fixed against rotation relative to exterior barrel 14.

A hollow guide tube 30 is fixed at its lower end within the counterbored upper portion 28 of cylindrical portion 22. Guide tube 30 has a longitudinal slot 32 extending along one side. Slot 32 is closed by tube lower stop 34 at its lower end. A low friction (e.g. Teflon) washer 36 is provided around guide tube 30 against the upper end of cylindrical portion 22.

The guide tube is fixed to the cylindrical portion which is fixed to the lower exterior barrel. These three elements constitute the stationary elements of the assembly which are not intended to rotate relative to each other.

In order to link the upper exterior cap 12 to the rotating interior elements of the lead-propelling mechanism, a knurled cap bushing 38 is rotatably mounted about guide tube 30 above Teflon washer 36. The intermediate tube 18 is tightly fitted over and grips knurled cap bushing 38. The exterior cap 12 is likewise fitted over and tightly grips the intermediate tube 18. Thus, exterior cap 12, intermediate tube 18, and knurled cap bushing 38 are locked together and rotate together.

Also rotatably mounted about guide tube 30 above the knurled cap bushing 38 is a clutch bushing 40. Clutch bushing 40 has a lower rim or face 42 which has a surface designed to fit flush against the mating upper rim or face 44 of knurled cap bushing 38. Mating faces 42 and 44 act as a clutch assembly and have mating surfaces with selected coefficients of friction. That is, during normal operation, knurled cap bushing face 44 and clutch bushing face 42 are biased together and rotate together whenever upper exterior cap 12 is rotated to move the lead longitudinally. In the event that excessive torque forces are encountered (as will be subsequently explained in detail), the clutch bushing face 42 is designed to slip on and to cease rotating with knurled cap bushing face 44. In other words, clutch bushing 40 stops when excessive torque forces occur and knurled cap bushing 38 rotates harmlessly.

Another element which is rotatably mounted about guide tube 30 is helical worm spring 46. It is held on the guide tube by stop means 48 formed at the guide tube's upper end. For example, three radially extending protrusions 48 are pressed out and a washer 50 is mounted just below the protrusions. A Teflon non-slip washer 52 is added to provide a smooth surface for the upper end of worm spring 46 to bear against.

Figure 5:
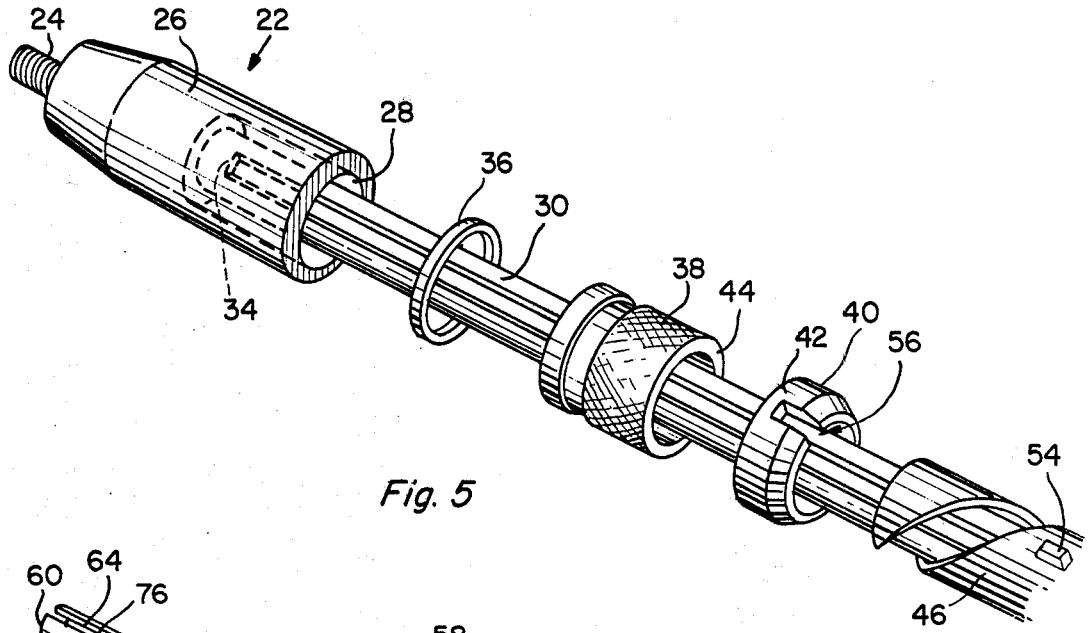
FIG. 5 is a perspective view of the lower end of the interior elements of the mechanical pencil, the various elements being slipped upwardly along the guide tube and separated for purposes of clarity.
Figure 6:
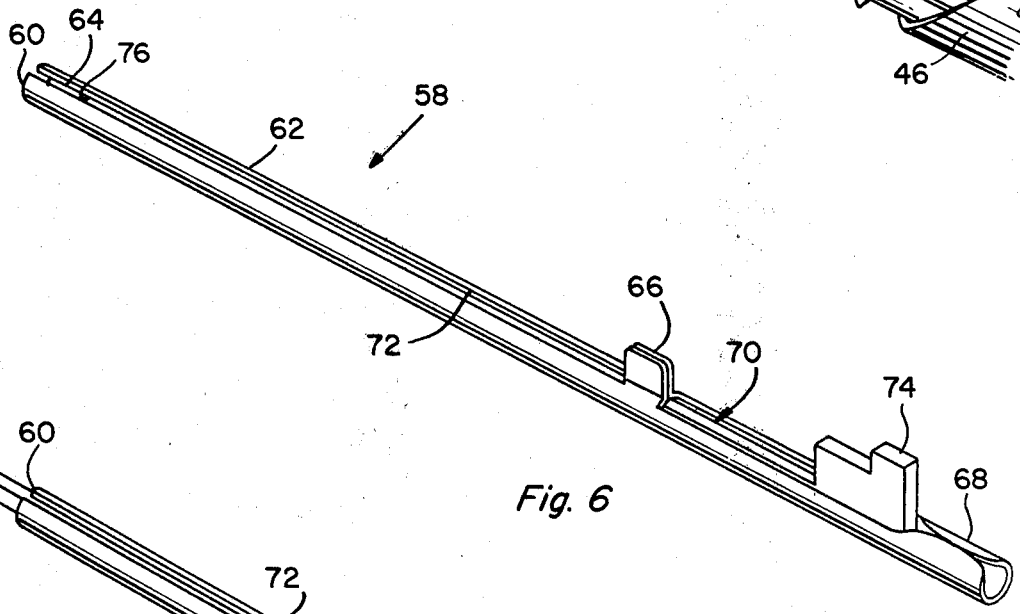
FIG. 6 is a perspective view (greatly enlarged) of the lead-carrying mechanism, the lead expeller rod being retracted within the lead carrier.
Figure 7:
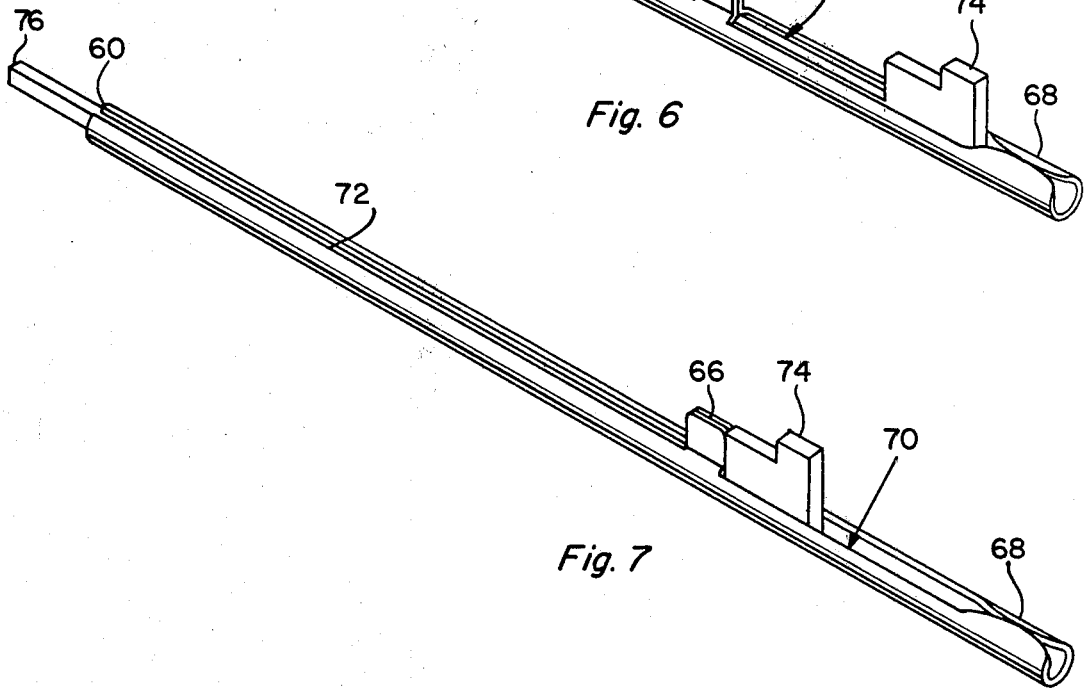
FIG. 7 is a perspective view of the lead-carrying mechanism of FIG. 6, the lead expeller rod being advanced within the lead carrier.
Figure 8:
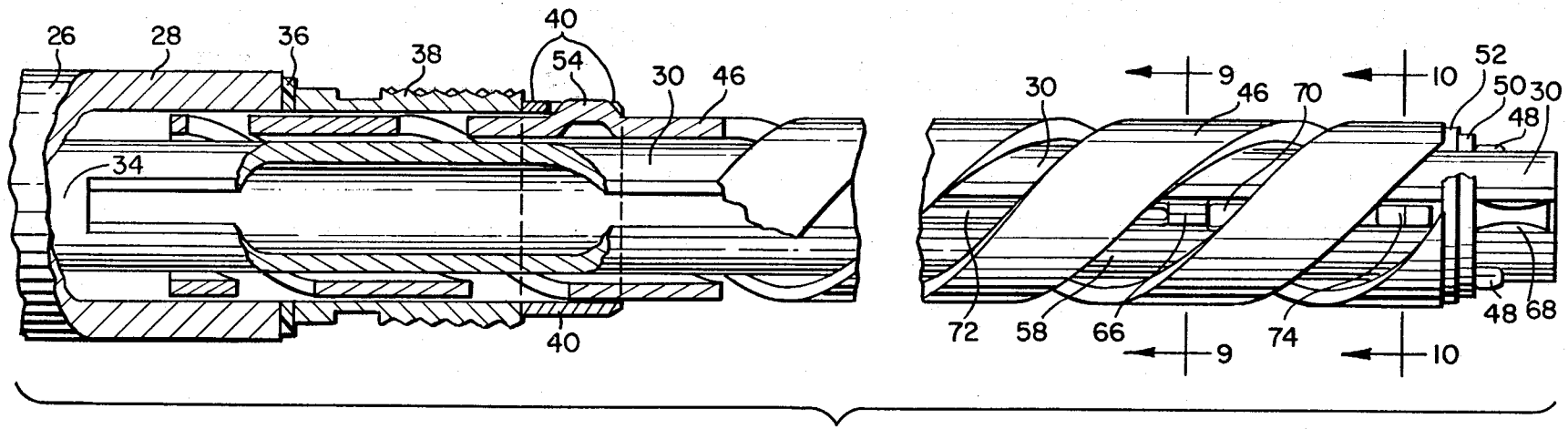
FIG. 8 is a view, partly in section, of the mechanism shown in FIG. 4, the lead-carrying mechanism being in the full retracted position.
Figure 9:
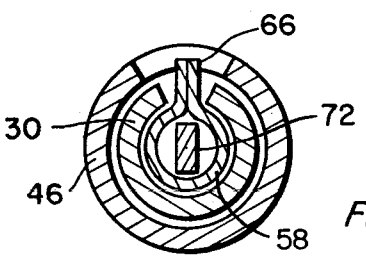
FIG. 9 is a sectional view taken along line 9—9 of FIG. 8.
Figure 10:
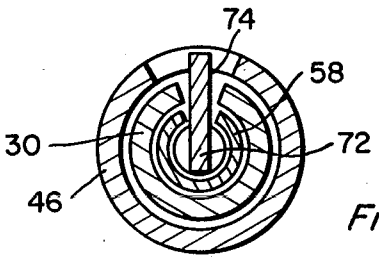
FIG. 10 is a sectional view taken along line 10—10 of FIG. 8.

The lower end of worm spring 46 telescopes into clutch cap bushing 40, into knurled bushing 38, and into the counterbored portion 28 of cylindrical portion 22. Worm spring 46 is not fixed to knurled cap bushing 38 or to cylindrical portion 22. However, the worm spring is fixed to clutch bushing 40 by a lug and keyway arrangement (or any other means). In FIGS. 5 and 8, it will be seen that a lug 54 on worm spring 46 fits into a keyway 56 on clutch bushing 40 to lock the two elements together. The worm spring is slightly compressed between clutch bushing 40 and guide tube stop 48 and biases clutch bushing 40 against knurled cap bushing 38.

To carry the lead, a tubular lead carrier 58 is sized and shaped to fit within guide tube 30 and to easily slide along the tube. The lead carrier has a lower apertured end 60 which is adapted to resiliently grip a length of pencil lead. Lead carrier 58 is preferably a flat strip which is rolled into a longitudinally split hollow tube. The lower portion 62 of the tube is essentially closed (i.e. is formed into a circular tube) or has a small longitudinal split 64 in its tubular periphery. At approximately the longitudinal midpoint of the lead carrier, two ears are provided which butt together and form a single radially protruding ear 66. At the upper end of the lead carrier, the hollow tube is rolled full circle so that there remains no split. This forms an upper end stop 68.

Between protruding ear 66 and upper end stop 68 is a longitudinal slot 70. This slot is necessary whereas any lower portion split is unnecessary.

A lead expeller rod 72 is fitted to slide within lead carrier 58. Rod 72 is a square or round rod which has an ear 74 formed at its upper end. Ear 74 protrudes out of lead carrier slot 70 and is disposed parallel to carrier ear 66. As rod ear 74 slides down towards carrier ear 66, lower rod end 76 moves down and then protrudes out of carrier lower end 60 (to eject the lead). As rod ear 74 slides up away from carrier ear 66, lower rod end 76 moves up and returns into carrier lower end 60.

The lead carrier ear 66 and the lead expeller rod ear 74 are maintained longitudinally spaced-apart by the interposition of one turn of the helical worm spring 46 as shown in FIG. 8. As the worm spring is rotated about guide tube 30, the ears 66 and 74 are cammed and lead carrier 58 is moved along guide tube slot 32.

In operation, the upper exterior cap 12 is rotated (while the lower exterior barrel 14 is held stationary) to move the lead carrier 58 up and down guide tube slot 32. At the lower end of guide tube 30, continued rotation of worm spring 46 cams rod ear 74 towards stopped carrier ear 66 to eject the lead.

The foregoing description has covered all of the conventional elements of the mechanical pencil and the preferred embodiment of the improved clutch means. This preferred embodiment and several alternative clutch embodiments will now be described in detail. The problem that this invention is intended to solve occurs when the upper exterior cap 12 is rotated to advance the lead carrier elements hard against the guide tube lower stop 34 or is rotated to retract the lead carrier elements hard against the guide tube upper stop 48. In either event, there is considerable likelihood that the lead expeller rod ear 74 will be scissored between worm spring 46 and lower stop 34 or upper stop 48 (or washers 52 and 50) and deformed. Also, there is the possibility that Teflon washer 52 will be cracked or that worm spring 46 will be bent.

To prevent such damage to the interior mechanism, a clutch means is provided between the upper exterior cap 12 and the worm spring. Under normal torque load conditions, the clutch is engaged and the cap 12 and worm spring 46 rotate together. However, when an excessive torque load develops (e.g. when the lead carrier elements are advanced or retracted hard against the guide tube stops), the clutch becomes disengaged (i.e. slips) and the worm spring stops rotating, thereby reducing the torque load.

The clutch means can take many forms. In the preferred embodiment shown in the drawings, cap 12 is fixed to intermediate tube 18 which, in turn, is fixed to knurled cap bushing 38. Clutch bushing 40 is fixed to worm spring 46 which drives lead carrier 58 longitudinally. When cap 12 is rotated to advance the lead, the carrier 58 moves downwardly until it strikes guide tube lower stop 34. Then, rod ear 74 is cammed forwardly until it strikes carrier ear 66. Similarly, when cap 12 is rotated to retract the lead, the carrier 58 moves upwardly until rod ear 74 strikes Teflon washer 52. In either situation, if cap 12 is further rotated, knurled cap bushing 38 will continue to rotate with cap 12, but clutch bushing 40 will slip, and worm spring 46 will instantly stop, thus preventing any damage to the mechanism. The torque load level at which clutch bushing 40 will slip on knurled cap bushing 38 can be selected by carefully choosing the mating clutch face materials and the worm spring compressive force. By a trial and error development process, the appropriate set-up can be achieved wherein the critical torque level at which the clutch begins to slip is low enough to prevent damage to the mechanism, yet is high enough to provide firm and responsive lead movement capability.

Figure 11:
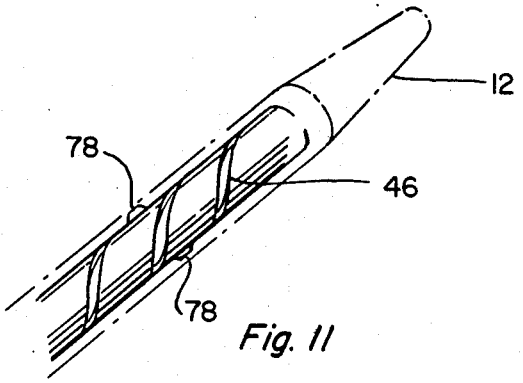
FIG. 11 is a perspective view of an alternative clutch means.

An alternative clutch means, shown in FIG. 11, is simply the provision of a direct frictional peripheral connection between the interior of cap 12 and the exterior of worm spring 46. For example, worm spring 46 could have two upstanding shoulders 78 for frictional engagement with the cap. In this arrangement, some or all of the following elements shown in the drawings could be eliminated: tube 18, washer 36, knurled cap bushing 38, clutch bushing 40, and lug 54. The clutch means would consist simply of the cap and the worm spring remaining fixed together until the torque load on the worm spring exceeded a set level. Then, the worm spring would cease rotating and the cap would slip harmlessly about the worm spring. Although a workable alternative, this arrangement is not as smooth-acting as the preferred embodiment.

Figure 12:
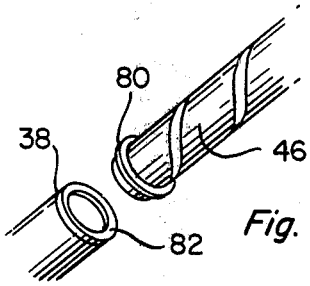
FIG. 12 is a perspective view of another alternative clutch means.

Another alternative clutch means, shown on the right side of FIG. 12, is the provision of a washer 80 affixed near the lower end of worm spring 46. The washer 80 bears against the upper end of knurled cap bushing 38. Alternatively, a second similar washer 82 could be affixed to the upper end of knurled bushing 38 so that the two washers will bear against each other in the manner of facing clutch plates.

Figure 13:
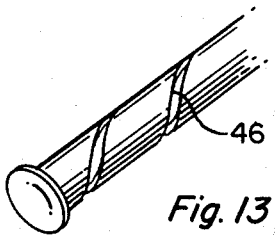
FIG. 13 is a perspective view of another alternative clutch means.

Alternatively, as shown in FIG. 13, the lower end of worm spring 46 could be formed with a flat bearing surface to ride directly on the upper end of knurled cap bushing 38.

Figure 14:
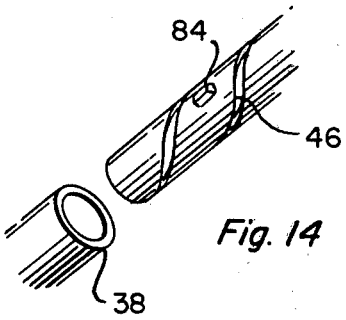
FIG. 14 is a perspective view of another alternative clutch means.

Another alternative clutch means, shown in FIG. 14, would be the provision of one radially extending clutch shoulder 84 near the lower end of worm spring 46. This clutch shoulder 84 would have a lower portion which faces and bears against the upper end of the knurled cap bushing. Preferably, the upper end surface of the knurled cap bushing would be slightly irregular or roughened to provide the sufficient amount of friction for clutch engagement, yet not so much as to prevent clutch slippage in the event of excess torque loads.

Other alternative clutch means could be described, but this invention is intended to be quite broad and is to be limited only by the scope of the attached claims. In particular, cap 12 is designed to be linked to worm spring 46 through a clutch means which will lock the two elements together under normal torque loading conditions. However, under excessive torque loading conditions, the clutch means will disengage the worm spring 46 so that further rotation of cap 12 will not rotate worm spring 46 at all. Thus, it is impossible to damage the mechanism by over-rotating the cap.

It will be understood that the scope of this invention is limited only by the appended claims. Obvious modifications of this disclosure are intended to be included within the scope of this invention. The described or illustrated embodiments are for purposes of illustration only.

I claim:

1. In a mechanical pencil having the following conventional elements:

(a) a lower exterior barrel having an axial bore;

(b) a lower cylindrical portion sized and shaped to fit within and to be fixed against rotation relative to the lower exterior barrel, said cylindrical portion also having an axial bore;

(c) a hollow guide tube having a longitudinal slot along one side, said guide tube being fixed to and extending upwardly from the upper end of the cylindrical portion, said guide tube also having an axial bore;

(d) support means mounted near the lower end of the guide tube above the upper end of the cylindrical portion;

(e) a radially extending stop means mounted on the upper end of the guide tube;

(f) a worm spring rotatably mounted on the guide tube between the support means and the stop means, said worm spring being axially compressed;

(g) a tubular lead carrier sized and shaped to fit within and to slide along the guide tube, said lead carrier having a lower apertured end for resiliently gripping the end of a length of pencil lead, said lead carrier having a radially protruding ear near its longitudinal midpoint, said lead carrier having a longitudinal slot formed between its protruding ear and its upper end where the slot is closed;

(h) a lead expeller rod sliding within the tubular lead carrier, said rod having a radially protruding ear near its upper end, said rod ear protruding through the lead carrier slot parallel to the lead carrier ear, said rod ear being slidable along the slot towards and away from the lead carrier ear;

(i) the lead carrier ear and the lead expeller rod ear being maintained longitudinally spaced-apart by the interposition of one turn of the helical worm spring, the lead carrier moving along the guide tube in response to rotation of the worm spring about the guide tube; and (j) an upper exterior cap sized and shaped to fit over the worm spring, said exterior cap rotatably linked to the worm spring whereby rotation of said exterior cap causes rotation of the worm spring which causes reciprocation of the lead carrier along the full length of the guide tube slot;

the improvement therein comprising: clutch means for yieldably fixing the lower portion of the worm spring to the upper portion of the support means, said clutch means engaging under conditions of worm spring torque load below a selected load level causing the worm spring to rotate with the rotating support means, said clutch means disengaging when the worm spring encounters torque forces in excess of the selected load level causing the worm spring to slip relative to the rotating support means and to remain stationary relative to the guide tube preventing damage to the mechanism, said improved clutch means further comprising:

(i) the support means being a cap bushing coaxially and rotatably mounted on the guide tube;

(ii) the upper exterior cap gripping the cap bushing and being fixed against rotation relative thereto whereby rotation of the exterior cap causes rotation of the cap bushing;

(iii) the clutch means further including a clutch bushing coaxially and rotatably mounted on the guide tube above the upper end of the cap bushing, said clutch bushing being fixed against rotation and being fixed against upward movement relative to the lower end of the worm spring; and (iv) the cap bushing having an upper rim extending perpendicular to the axis of the cap bushing, the clutch bushing having a lower rim extending perpendicular to the axis of the clutch bushing, the cap bushing upper rim and the clutch bushing lower rim facing each other and being axially pressed together into frictional contact by the axially exerted spring force of the compressed worm spring.

2. The mechanical pencil of claim 1 wherein the worm spring has a lug formed near its lower end, said clutch bushing has a keyway formed in its upper end, and said worm spring lug fits in said clutch bushing keyway to fix the worm spring to said clutch bushing.

3. The mechanical pencil of claim 2 wherein the cap bushing has exterior knurling to provide a gripping surface for the upper exterior cap, and a slip ring is rotatably mounted on the guide tube between the upper end of the cylindrical portion and the lower end of the cap bushing to reduce rotational friction between the cylindrical portion and the cap bushing.

* * * * *